US006472602B1

(12) United States Patent
Pokrandt

(10) Patent No.: US 6,472,602 B1
(45) Date of Patent: Oct. 29, 2002

(54) ELECTRIC FENCE LINE AND METHOD OF WEAVING

(76) Inventor: Gary Pokrandt, P.O. Box D, Walthourville, GA (US) 31333

( * ) Notice: Subject to any disclaimer, the term of this patent is extended or adjusted under 35 U.S.C. 154(b) by 0 days.

(21) Appl. No.: 09/618,389

(22) Filed: Jul. 18, 2000

(51) Int. Cl.[7] ..... H01B 7/08
(52) U.S. Cl. ..... 174/117 M; 256/10
(58) Field of Search ..... 174/117 F, 117 M, 174/36; 256/10, 45; 57/237; 139/425 R; 87/6–8

(56) References Cited

U.S. PATENT DOCUMENTS

| | | | | |
|---|---|---|---|---|
| 3,805,667 | A | | 4/1974 | Orser |
| 3,980,277 | A | | 9/1976 | Enoksson |
| 4,494,733 | A | | 1/1985 | Olsson |
| 4,527,135 | A | | 7/1985 | Piper |
| 4,728,080 | A | | 3/1988 | Kurschner et al. |
| 4,861,645 | A | | 8/1989 | Standing |
| 5,036,166 | A | | 7/1991 | Monopoli |
| 5,760,340 | A | * | 6/1998 | Orr, Jr. et al. ..... 174/117 F |

* cited by examiner

*Primary Examiner*—Chau N. Nguyen
(74) *Attorney, Agent, or Firm*—Brian D. Bellamy

(57) ABSTRACT

An electric fence line including a flat tape of plastic monofilament yarns and electrically conductive warp strands is disclosed having a diagonally crossing electrically conductive bonding wire. The electric fence line is constructed by weaving the supporting monofilament yarns in a parallel manner with the conductive warp strands and weaving therein a conductive bonding strand in a repeating pattern diagonally crossing the warp strands. The bonding strand is woven diagonally by repeatedly inserting the bonding strand at specific points through the warp yarns and a comb while moving the bonding strand laterally using a cam or linear actuator device when the bonding strand is held by a needle above the comb, warp yarns, and conductive warp strands. Electrically conductive 8 mil wire constructed of stainless steel is preferably used for the conductive warp strands and the bonding strand.

10 Claims, 6 Drawing Sheets

ELECTRIC FENCE LINE AND METHOD OF WEAVING

TECHNICAL FIELD

The present invention relates to electric fence lines comprising several electrically conductive wire strands woven along with several plastic monofilament yarns. More particularly, an additional electrically conductive wire strand is woven in a diagonally alternating pattern in relation to the conductive wires and plastic yarns.

BACKGROUND OF THE INVENTION

Electrically conductive fence wires connected to a high voltage energizing source are used to fence in animals or to exclude animals from certain areas. If an animal contacts the energized fence line, an electric shock is administered to the animal.

It has long been recognized that thick steel wire is bulky and expensive to produce. Further, steel wire is subject to corrosion. Using other materials besides steel of a sufficient gauge to be break-proof is cost prohibitive. For instance, stainless steel would be corrosion proof, but in a gauge the same as the thick steel wire would be much more expensive. Other corrosive resistant materials such as tinned copper, aluminum, or galvanized steel could also be used as an electrically conductive wire. However, these materials are typically more expensive than stainless steel. Further, using any of these materials in a sufficient thickness to ensure their strength may cause them to be very bulky and heavy in shipping and in installation.

Flat tapes woven of plastic monofilament yarn and woven with a warp including multiple conductive wire strands have been found advantageous for use as electric fence lines because thin conductive strands of stainless steel or other corrosion proof material can be used. Because the conductive strands are so thin in these type tapes, much less of the conductive material is used than in a standard electric fence wire. Thus, the woven tapes are generally less expensive. These tapes are also enjoyed because they are very lightweight and easy to ship and install. These lightweight tapes are easier to relocate to modify or move a fenced area. Additionally, the lightweight tapes may be run over long distances, hundreds of feet, with less tensile force on the fence line.

Woven plastic tapes with a warp consisting of several conductive strands have still further advantages over the traditional single strand wire fence. In particular, the plastic tapes may be colored brightly to make them more visible to animals and humans. The visibility of the tapes prevents accidental electric shock and prevents accidental contact by vehicles and the like. A further advantage of these tapes comprising several conductive strands is that a particular strand or strands may break, but some strands may remain intact. Therefore, the fence will remain partially electrified, but at a higher resistance, even with some discontinuity of the conductors.

But these tapes have been found to have certain disadvantages. A primary example is that the thin electrically conductive wires of the tape's warp often break. When the thin conducting wires break, the electrified tape becomes less effective for administering an electric shock. A broken wire causes a discontinuity in the flow of the electric current in that particular conductive wire of the tape, increasing the overall electrical resistance of the tape. If several of the wires break, the resistance to the flow of the electric current is further increased and the downstream voltage and effectiveness of the electric fence tape decreases, accordingly.

Unfortunately, broken conductive wire strands in woven electric fence tape has been a persistent problem because the electrically conductive wires used in the tapes are so thin and fragile. Also, these tapes are frequently twisted and pulled during installation. The tapes are rolled and bundled for relocating or storing, and the flat plastic tapes are often installed by tacking them to fence posts. All of these factors and others contribute to conductive wires breaking.

It would be desirable to provide a flat woven tape construction for an electrically conductive fence line that mitigates these disadvantages.

U.S. Pat. No. 5,036,166 to Monopoli discloses a woven electric fence tape wherein a conductive wire having lower electrical resistance is woven in the warp of the tape and a conductive wire of higher strength and higher electrical resistance is interwoven in the tape and at intervals is traversed laterally of the tape for it to extend across the width of the tape. Monopoli claims that the weaving technique used to weave the Monopoli tape is well known in the art. Besides the specification of known weaving techniques in the 5,036,166 patent, Monopoli does not teach a means for weaving a low resistance conductive wire in bridging contact with electrically conductive warp strands.

SUMMARY OF THE INVENTION

The present invention provides an electric fence line comprising a flat tape or webbing preferably constructed of polyethylene or similarly suitable monofilament yarns. The warp of said tape further includes several electrically conductive wire strands woven parallel along with the monofilament yarns. An additional electrically conductive wire strand, referred to herein as a bonding strand, is woven in a diagonally alternating pattern in relation to the warp yarns and conductive wire strands by using a needle situated above said yarns and conductive strands to weave the bonding wire.

Ordinarily, in weaving a reed maintains proper separation of the warp yarns and also assists to pack the weft yarn into position after insertion. In the present invention, the ordinary reed has been replaced by a device, referred to herein as a comb. The comb has an open top end having several teeth. The gap between each of the teeth of the comb is utilized such that the needle can lift the bonding wire over the warp yarns and the comb for repositioning.

A synchronized cam moves the needle into position above the webbing for insertion of the bonding wire into a specified point in the webbing during the weaving process such that the bonding wire crosses over the conductive wire strands of the tape's warp while the warp strands are on top of the tape. Thereby, the bonding wire contacts each conductive wire as it crosses the tape diagonally.

DETAILED DESCRIPTION OF THE INVENTION

Figure 1:
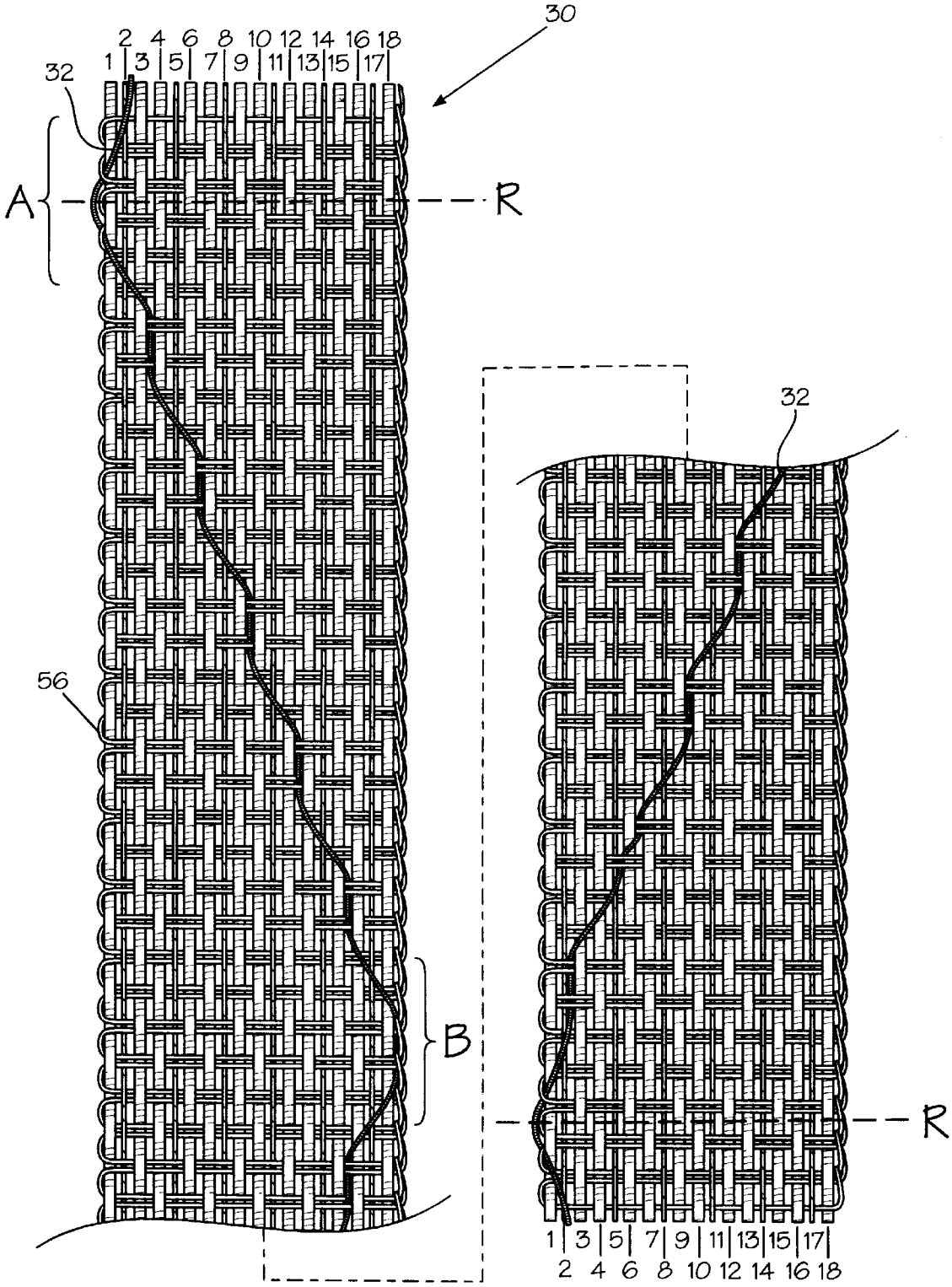
FIGS. 1 is a top elevational view illustrating a section of the woven electric fence line of the present invention where the appearance of a diagonally traversing conductive bonding wire is illustrated.
Figure 2:
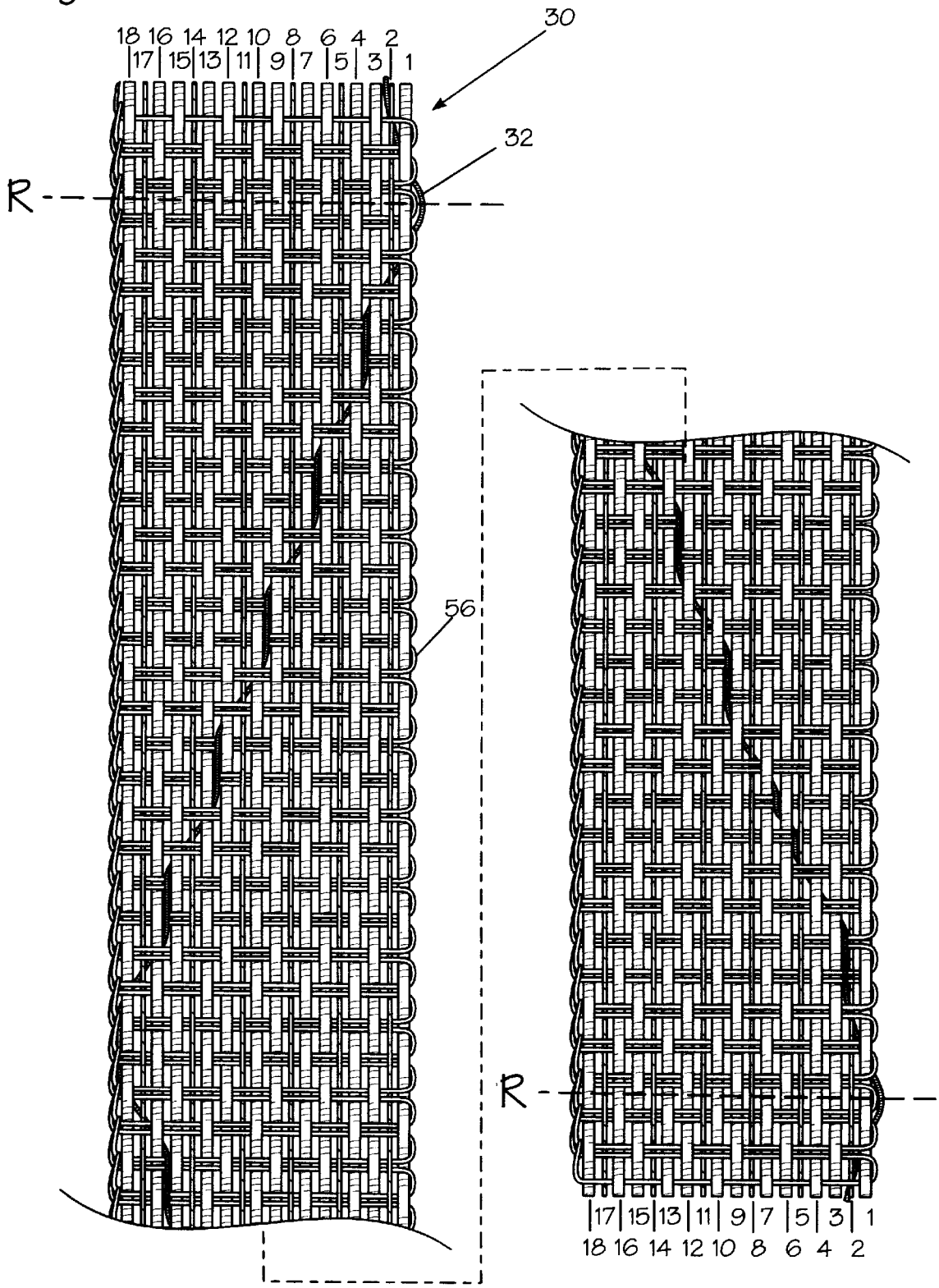
FIG. 2 is a bottom elevational view illustrating a section of the woven electric fence line.
Figure 3:
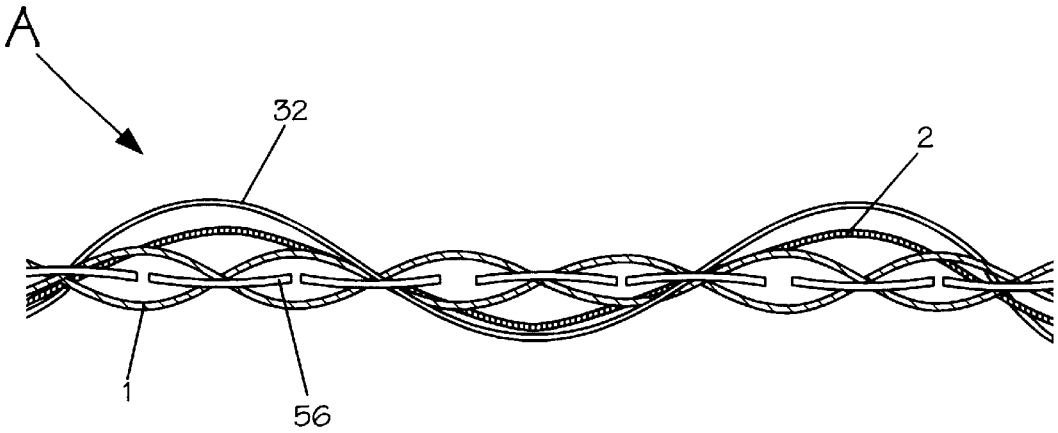
FIGS. 3 and 4 illustrate a section of the woven electric fence line, viewed from one edge A and then the other edge B as designated in FIG. 1.
Figure 4:
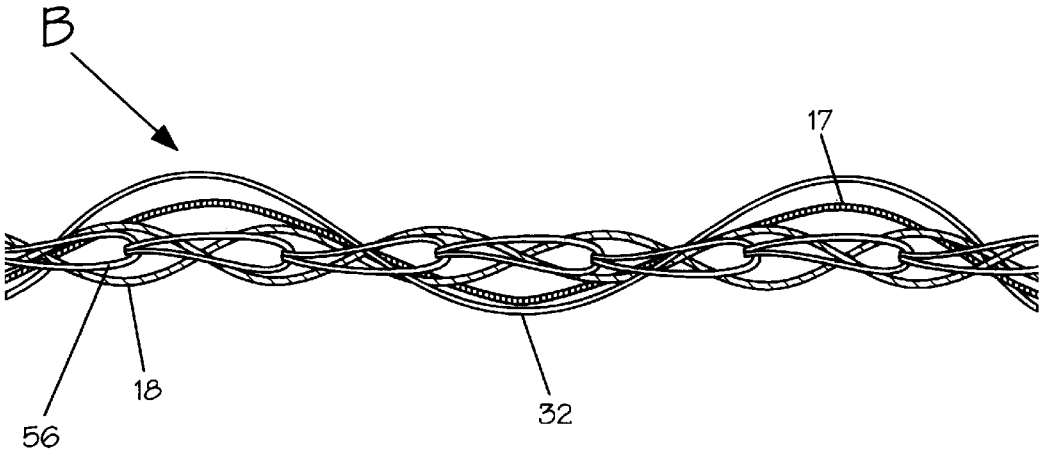
Figure 5:
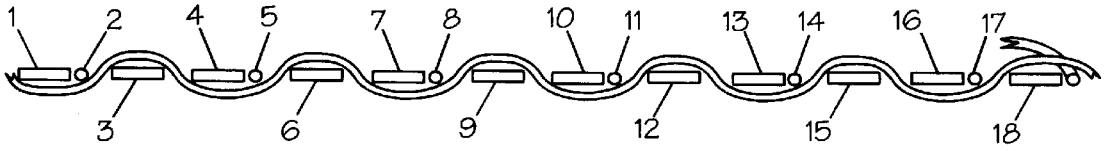
FIG. 5 is an end view of the woven electric fence line of the present invention.

Referring to FIGS. 1 to 5, an electric fence line is illustrated comprising a flat tape or webbing 30. The preferred tape 30 is constructed of monofilament yarns 1, 3, 4, 6, 7, 9, 10, 12, 13, 15, 16, and 18 as support members of the tape 30 as shown in FIGS. 1 and 2. The warp yarns 1, 3, 4, 6, 7, 9, 10, 12, 13, 15, 16, and 18 will be referred to collectively herein as warp yarns 118. Several electrically conductive wire strands 2, 5, 8, 11, 14, and 17, referred to collectively herein as wire strands 2–17, are woven parallel to the warp yarns 1–18 of the tape as shown in FIGS. 1 and 2. An additional electrically conductive wire strand 32, or bonding wire, is woven in a diagonally alternating pattern in relation to the yarns 1–18 and wire strands 2–17.

Figure 8A:
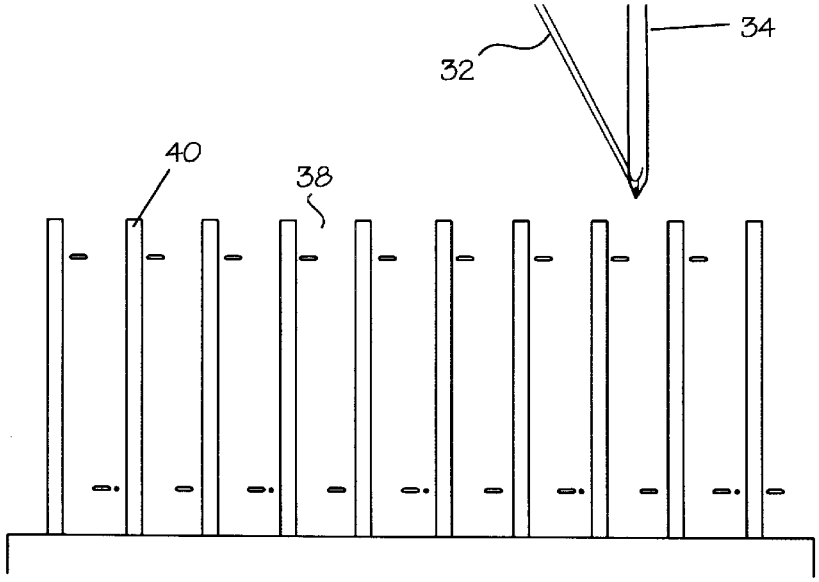
FIGS. 8*a*, 8*b*, and 8*c* illustrate a needle lifting a bonding wire over the teeth of the comb, inserting the bonding wire into a webbing with the bonding wire passing through the teeth of the comb, and then lowering the bonding wire below the warp material for insertion of a weft yarn.
Figure 8B:
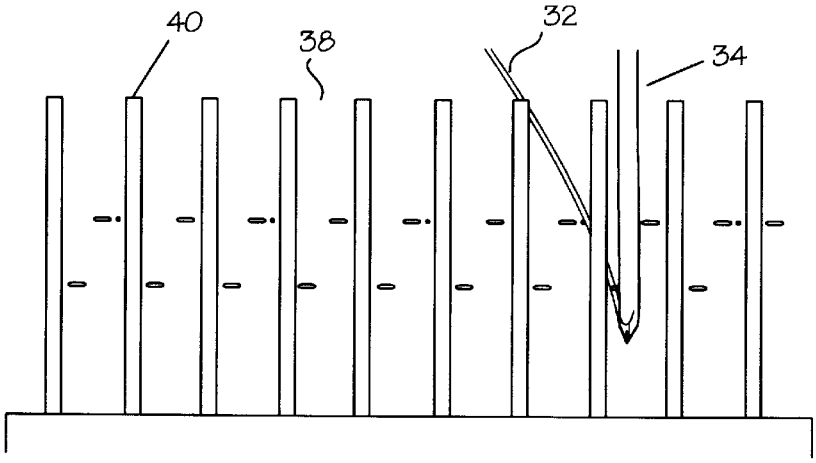
Figure 8C:
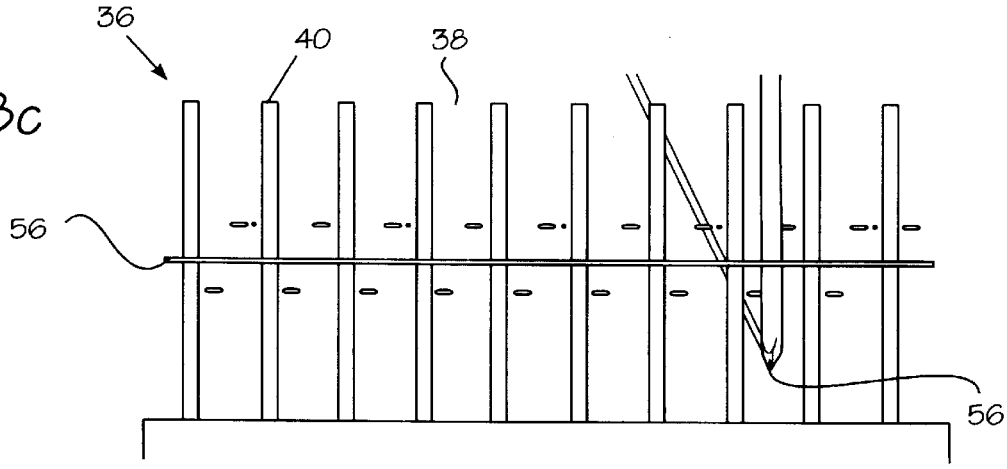

Referring to FIGS. 8*a* to 8*c*, the bonding wire 32 is woven in a diagonally alternating, pattern in relation to the yarns 1–8 by using a needle 34 situated above said yarns 1–18 to weave the bonding wire 32. A well known weaving technique is used to weave the nonconductive support members 1–18 and wire strands 2–17 to form the flat tape as shown in FIG. 1. The novel electric fence line of FIGS. 1 through 5 having the described bonding wire 32 is woven using a novel method of weaving described herein.

More specifically, as shown in FIGS. 6, 7, and 8*a* to 8*c*, a comb 36 is provided having an open end 38 at the top of the comb 36 with the bottom end being closed. Thus, a gap exists between each of the comb's vertical teeth 40 that allows the needle 34 to lift the bonding wire 32 over the comb's teeth 40 for repositioning. In the up position, the needle 34 moves the bonding wire 32 across the yarns 1–18 to cause the diagonally traversing zigzag weave shown in FIGS. 1 and 2. The movement of the needle 34 is controlled by a timing means that consists of a mechanical device such as a linear actuator or a cam assembly 42 whose desired motion is timed and synchronized with the rest of the loom's weaving elements. The timing means or cam assembly 42 moves the needle 34 into position above the yarns 1–18 for insertion of the bonding wire 32 into a specified point in the weave during the weaving process.

Figure 6:
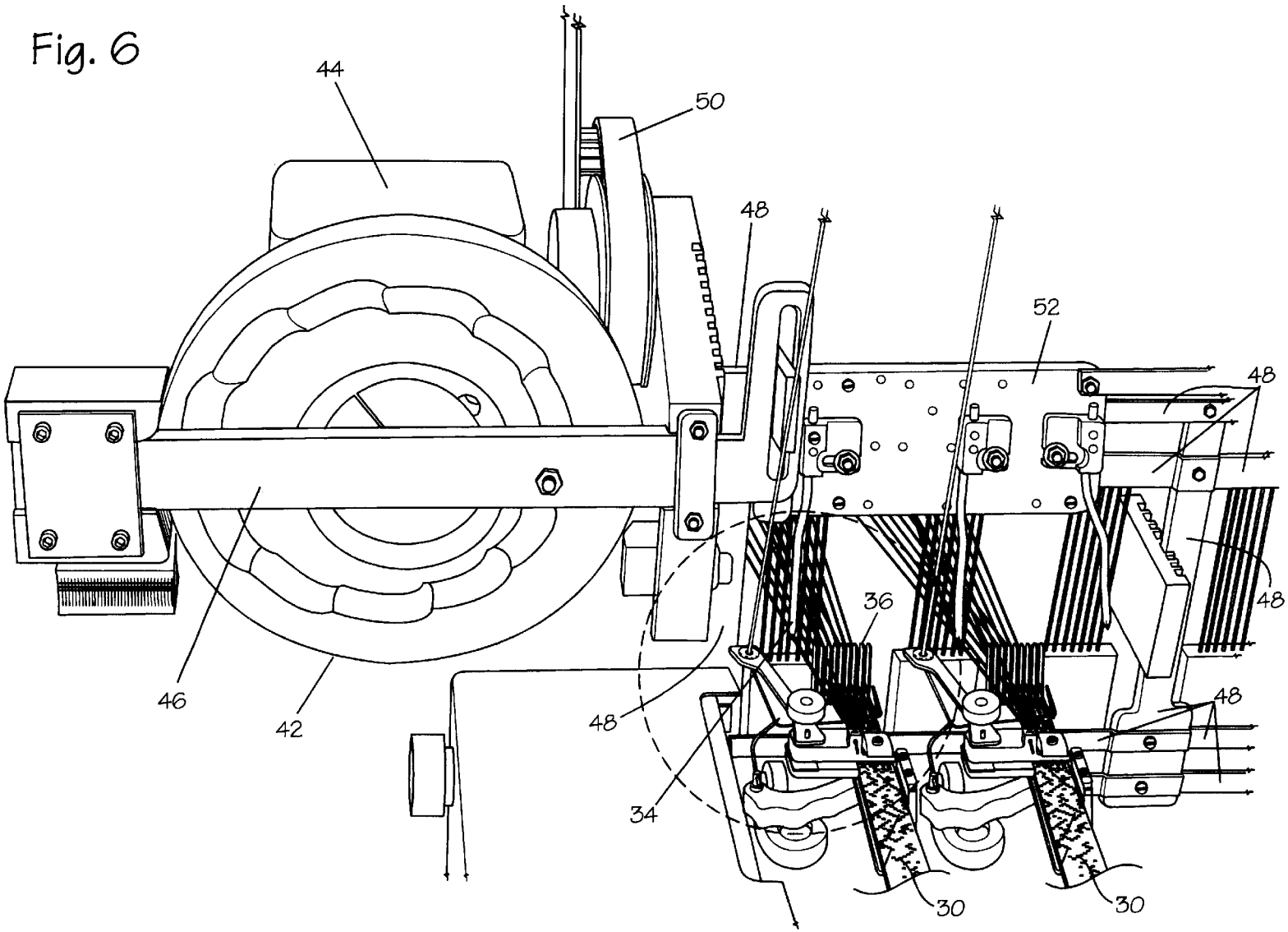
FIG. 6 illustrates an apparatus providing a mechanical means for weaving the electric fence line of the present invention.

As shown in FIG. 6, the synchronized cam 42 is controlled by a gear box 44. The cam 42 operates to move a linear bar 46 in synchronization with a needle lifting frame 48 whose up and down motion is controlled by conventional weaving devices or timing devices not shown in the figures. The cam 42 moves the linear bar 46 laterally. The linear bar 46 is linked to a laterally advancing block 52 that holds the needles 34 in position with respect to the yarns 1–18. Therefore, as the linear bar 46 and block 52 move laterally, the needles 34 position the bonding wires 32 above the yarns 1–18 for insertion. Once the needles 34 are positioned by the cam 42 at a specific position for weaving the bonding strand 32, the frame 48 lowers the needles 34 and inserts the bonding strand 32 into the yarns 1–18 and conductive strands 2–17 by passing the bonding wires 32 through the comb 36, as shown in FIG. 8*b* and 8*c*.

FIG. 8*b* illustrates the insertion of the bonding wire 32 into the weave of monofilament yarns 1–8 and electrically conductive warp strands 2–17. The bonding wire 32 is inserted such that the bonding wire 32 crosses over the conductive wire strands 2–17 of the tape's warp while the conductive warp strands 2–17 are on top of the tape 30. Thereby, the bonding wire 32 contacts each conductive wire 2–17 as it crosses the tape 30 diagonally. The needle 34 moves the bonding wire 32 completely through the webbing into the down position 54 shown in FIG. 7 such that a weft yarn 56 is inserted and woven with the warp yarns 1–18 and warp conductive strands 2–17. Further, the weft yarn 56 is woven with the diagonally crossing bonding wire 32. Thereby, the bonding wire 32 is retained securely in the woven tape 30.

Figure 7:
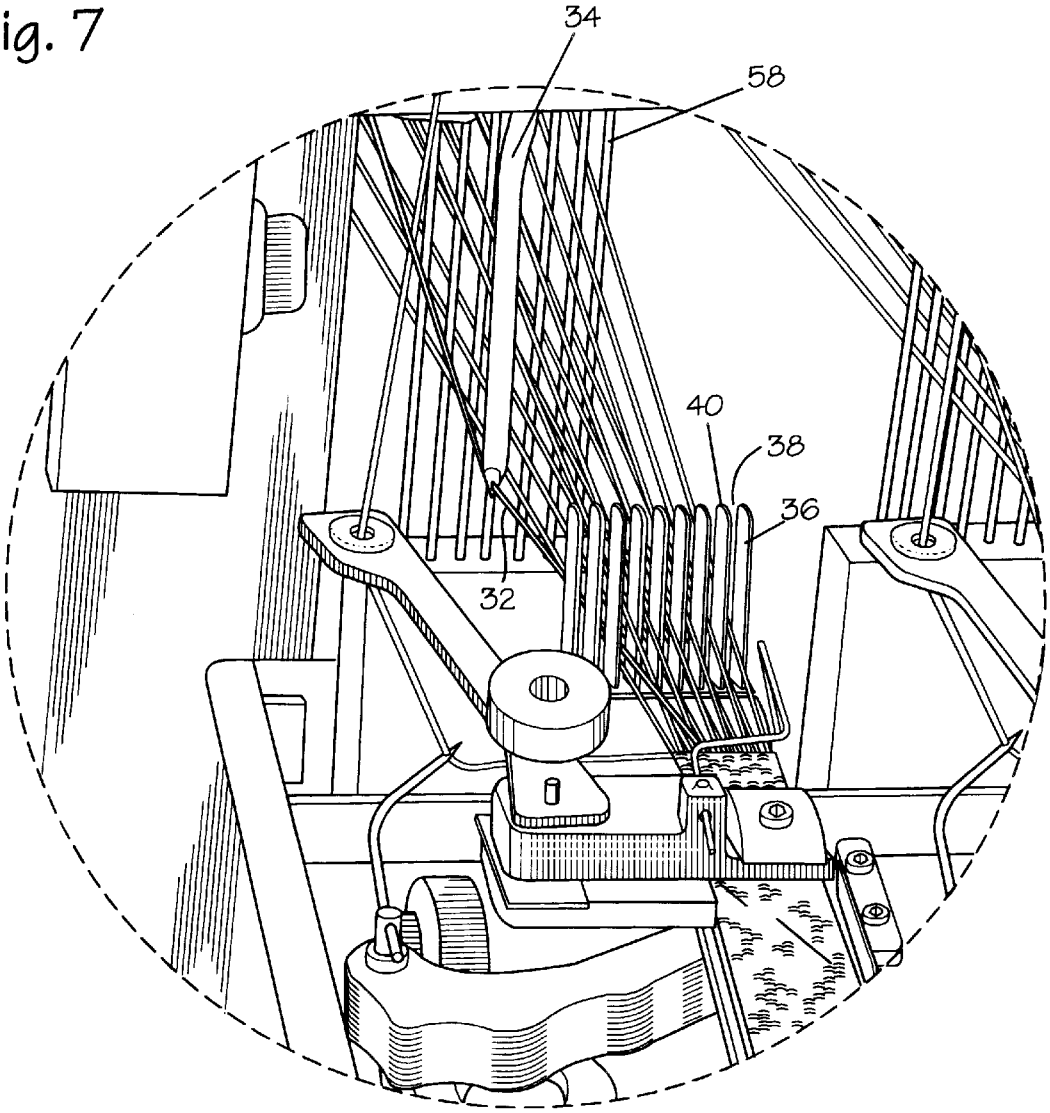
FIG. 7 is a cutaway view of the apparatus of FIG. 6 illustrating the comb used for weaving the electric fence line of the present invention.

A reed 58 as shown in FIGS. 6 and 7 may be included to separate the yarns 1–18 and parallel conductive wires 2–17 for insertion of the bonding wire 32. At insertion, the needle 34 is located at an intermediate location between the reed 58 and the comb 36. The separation of the yarns 1–18 and the wires 2–17 by the reed 58 permits insertion of the needle 34 and bonding wire 32 with precision at preferred points between the yarns 1–18 and the parallel conductive strands 2–17.

Preferably, the yarns 1–18 will consist of a monofilament yarn such as polyethylene. Polyethylene is advantageous because it is strong and lightweight, relatively inexpensive, withstands exposure to ultraviolet radiation, and maintains flexibility at low temperatures so that it does not crack and deteriorate. However, yarns of any composition having suitable properties, such as polypropylene and other plastics and non-plastics, may be considered as substitutes for polyethylene or monofilament type yarns.

Variations in the number of conductive warp strands 2–17 will be made depending upon the width of the tape 30 and the preferred application of the electric fence wire. The number of conductive strands 2–17 will further vary depending upon the preferred cost of the electric fence line, preferred conductivity, and other choices of the manufacturer and consumer.

Various conductive metals may comprise the conductive wire strands 2–17 used in the tape 30. Stainless steel is preferable because it is strong and does not corrode. However, stainless steel has a higher electrical resistance than alternative metals. For instance, copper or aluminum wire could be used in the tape, and these metals have superior conductivity compared to stainless steel. However, copper and aluminum corrode and are not as strong as stainless steel. Other conductive metals may also be considered as substitutes for stainless steel wire.

The conductive wire strands 2–17 are available in various diameters and any suitable diameter may be used in the present invention. In the embodiment herein, 8 mil wire is suggested as a preferred wire for the construction of the tape because of an advantageous combination of conductivity, strength and low cost. Although conductivity increases with a wire's diameter, larger diameter wire also increases the wire's cost. The diagonally crossing bonding strand 32 ensures that all of the conductive strands 2–17 in the tape's warp carry current. Thus, the loss of conductivity using 8 mil wire versus a larger diameter wire is tolerably resolved.

When an animal touches the tape 30 of the present invention, the animal receives an effective shock regardless of whether the animal only touches one or two of the conducting strands 2–17 or even if some strands 2–17 are broken. In particular, the bonding strand 32 maintains an evenly distributed electrical current through all of the conductive warp strands 2–17 and causes the resistance to the flow of electricity through the present tape 30 to remain low over longer distances. The effect of the bonding strand 32 on the overall conductivity and resistance of the conductive members 2–17 of the tape 30 translates into longer effective fence lines and the effective use of less powerful chargers. Thus, the present invention provides an effective lightweight, cost-efficient, and easily manageable electric fence line.

I claim:

1. An electric fence line comprising:

a plurality of elongated warp yarns and at least one elongated weft yarn woven into a substantially flat tape;

a plurality of electrically conductive warp strands woven substantially parallel into the tape in substantially parallel relation to the warp yarns;

at least one electrically conductive bonding strand woven into the tape in a repeating pattern crossing diagonally across each of the electrically conductive warp strands such that the bonding strand crosses each electrically conductive warp strand at positions spaced latitudinally and longitudinally of the electrically conductive warp strands, and at specified points the bonding strand is inserted above and below the weft yarn each time the bonding strand crosses diagonally.

2. An electric fence line as claimed in claim 1 in which said electrically conductive bonding strand has the same conductive properties as the electrically conductive warp strands.

3. An electric fence line as claimed in claim 1 in which said electrically conductive warp strands are constructed of stainless steel.

4. An electric fence line as claimed in claim 1 in which said bonding strand is constructed of stainless steel.

5. An electric fence line as claimed in claim 1 in which said elongated warp yarns and elongated weft yarn are polyethylene monofilament yarns, said electrically conductive warp strands are constructed of stainless steel, and said bonding strand is constructed of stainless steel.

6. An electric fence line comprising:

a plurality of elongated wrap yarns and at least one elongated weft yarn constructed of polyethylene monofilament yarns woven into a substantially flat tape;

a plurality of electrically conductive warp strands constructed of stainless steel woven substantially parallel into the tape in substantially parallel relation to the warp yarns;

at least one electrically conductive bonding strand constructed of stainless steel woven into the tape in a repeating pattern crossing diagonally across each of the electrically conductive warp strands such that the bonding strand crosses each electrically conductive wrap strand at positions spaced latitudinally and longitudinally of the electrically conductive wrap strands;

said electrically conductive warp strands and said bonding strand constructed of 8 mil wire.

7. An electric fence line as claimed in claim 1 in which said bonding strand conductively contacts each electrically conductive warp strand as the bonding strand crosses said electrically conductive warps strands.

8. A method of constructing a woven electric fence line comprising:

providing a plurality of warp yarns and at least one weft yarn;

providing a plurality of electrically conductive warp strands;

providing at least one electrically conductive bonding strand;

weaving said warp yarns, said weft yarn, and said warp strands into a substantially flat tape;

while weaving said tape, repeatedly weaving said electrically conductive bonding strand into said tape by moving the bonding strand laterally into a first position above or below said warp yarns, moving the bonding strand between said warp yarns into a second position spatially separated from the first position, inserting said weft yarn between a portion of said warp yarns and said bonding strand, and returning said bonding strand back into the first position above or below said warp yarns;

whereby, said bonding strand is woven in a repeating pattern diagonally crossing the warp yarns and the electrically conductive warp strands.

9. A method of constructing a woven electric fence line as claimed in claim 8 that includes providing a comb having a closed bottom end and an open top end and having a plurality of teeth for laterally separating the warp yarns and electrically conductive warp strands before said step of weaving said warp yarns, said weft yarn, and said warp stranding into a substantially flat tape.

10. A method of constructing a woven electric fence line comprising:

providing a plurality of warp yarns and at least one weft yarn;

providing a plurality of electrically conductive warp strands;

providing at least one electrically conductive bonding strand;

providing a comb having a closed bottom end and an open top end and having a plurality of teeth for laterally separating the warp yarns and electrically conductive wrap strands; weaving said warp yarns, said weft yarn, and said warp strands into a substantially flat tape;

while weaving said tape, repeatedly weaving said electrically conductive bonding strand into said tape by moving the bonding strand laterally into a specific position above or below said warp yarns by moving the bonding strand laterally while said strand is being held by a needle above said comb, moving the bonding strand between said warp yarns, inserting said weft yarn between a portion of said warp yarns and said bonding strand, and returning said bonding strand back into the position above or below said warp yarns;

whereby, said bonding strand is woven in a repeating pattern diagonally crossing the warp yarns and the electrically conductive warp strands.

* * * * *